United States Patent [19]

Cooper et al.

[11] 4,105,207

[45] Aug. 8, 1978

[54] PINBALL TYPE BASEBALL GAME

[75] Inventors: Julius Cooper, New Hyde Park; Vincent Carella, Queens Village; Edwin Nielsen, Oceanside; Henry Nemeth, Massapequa, all of N.Y.

[73] Assignee: Ideal Toy Corporation, Hollis, N.Y.

[21] Appl. No.: 715,277

[22] Filed: Aug. 18, 1976

[51] Int. Cl.[2] ..... A63F 7/06

[52] U.S. Cl. ..... 273/89; 273/118 D; 273/121 R

[58] Field of Search ..... 273/88–93, 273/118–125, 1 R

[56] References Cited

U.S. PATENT DOCUMENTS

| | | | |
|---|---|---|---|
| 1,617,789 | 2/1927 | Bamber et al. | 273/89 |
| 1,975,374 | 10/1934 | Rockola | 273/88 X |
| 3,525,525 | 8/1970 | Rideout | 273/89 |
| 3,754,759 | 8/1973 | Brescow et al. | 273/1 R |

*Primary Examiner*—Paul E. Shapiro
*Attorney, Agent, or Firm*—Richard M. Rabkin

[57] ABSTRACT

A pinball type baseball game is disclosed in which a play surface simulating a baseball diamond is rotatably mounted on a frame. A plurality of figurines are adapted to be selectively and removably mounted on the play surface at predetermined locations representing the bases of the diamond. A selectively operable drive and control mechanism is provided in the frame for rotating the play surface on the frame in an apparently random sequence of different angular movements of one revolution or less to simulate movement of baseball players when the batter has achieved a "hit". The drive and control mechanism is activated by the projection of a ball on the play surface into a predetermined pocket on the play surface representing the "hit".

14 Claims, 8 Drawing Figures

PINBALL TYPE BASEBALL GAME

The present invention relates to game apparatus, and more particularly to a pinball type baseball game.

Mechanical games of various types have been proposed in the past which enable a player to simulate the game of baseball on a play surface. Two such games are disclosed in U.S. Pat. Nos. 2,240,276 to Williams et al. and 1,975,374 to Rockola. The latter relates specifically to a pinball type of game in which the player projects a ball along a play surface in an attempt to have the ball into a specified "hit pocket". When this occurs the ball enters onto a rotating disc and a control mechanism causes the disc to rotate. The mechanism disclosed in Rockola is extremely complicated and expensive to produce; and it is primarily intended for use in commercial type coin operated pinball machines. It would not be economically feasible to produce such a device for use as an inexpensive home entertainment toy for children.

Accordingly, it is an object of the present invention to provide a pinball type baseball game which is suitable for use by children.

Another object of the present invention is to provide a pinball type game which is relatively inexpensive to produce and simple to manufacture.

A further object of the present invention is to provide a pinball type game which is durable in construction and suitable for use as a home entertainment toy.

A still further object of the present invention is to provide a relatively simple control mechanism for controlling rotation of a disc in a toy or other device which will produce an apparently random rotary movement or series of rotary movements in the disc.

In accordance with an aspect of the present invention a pinball type baseball game has a frame which includes a ball guide track and a plurality of ball receiving pockets communicating with the track. Individual play balls are selectively projected along the guide track towards the pockets by a projection mechanism in an attempt to have the balls enter a designated "hit" pocket.

A play surface is rotatably mounted on the frame and simulates a baseball diamond. A plurality of figurines are adapted to be selectively and removably mounted on the play surface at predetermined locations thereon representing the bases of the diamond. As a new player comes to "bat" a figurine is placed on the play surface at a position representative of "home plate". A ball is then projected into the guide track towards the pockets in the frame.

The projection mechanism is operatively connected to energize a drive means in the frame for rotating the play surface. Rotation of the play surface in response to the drive means is controlled by a releasable stop arrangement which is operatively associated with the "hit" pocket for normally holding the play surface against rotation by the drive means and for releasing the play surface for limited rotation by the drive means through an arc of varying lengths, of one revolution or less, according to a predetermined and apparently random pattern in response to entrance of a ball into the "hit" pocket. When the figurine placed at the "home plate" position has moved with the play surface through one complete revolution, it is automatically removed from the surface to signify the scoring of a "run".

The above, and other objects, features and advantages of this invention will be apparent in the following detailed description of an illustrative embodiment thereof, which is to be read in connection with the accompanying drawings, wherein:

FIG. 1 is a perspective view of a pinball type baseball game constructed in accordance with an embodiment of the present invention;

FIG. 1*a* is an enlarged sectional view illustrating the mounting of one of the figurines in the game on the rotating disc;

Figure 1:
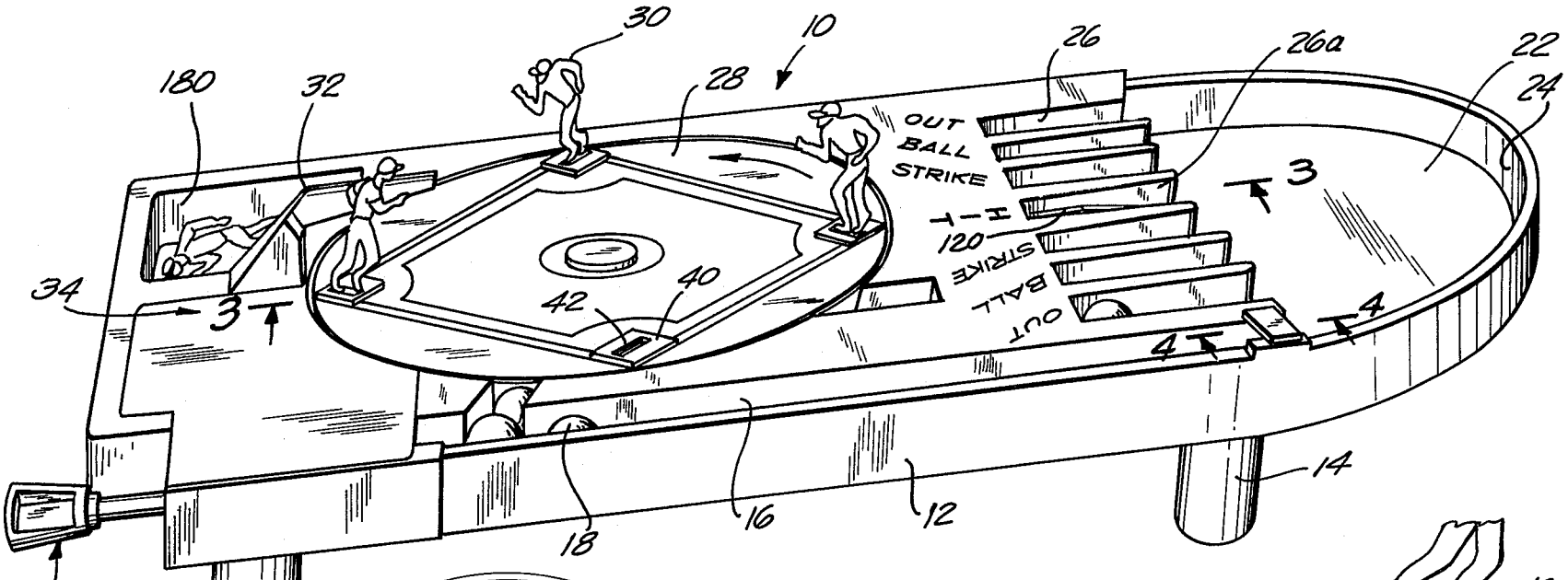
Figure 1A:
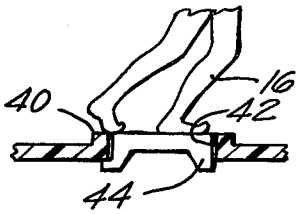
Figure 4:
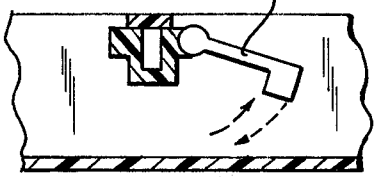
FIG. 4 is a sectional view taken along line 4—4 of FIG. 1.

Referring now to the drawings in detail, and initially to FIG. 1 thereof, a toy pinball type baseball game 10 includes a base or frame 12 having a plurality of legs 14 for supporting the frame on a table top or the like. Preferably legs 14 at the right end of the game (as illustrated in FIG. 1) are somewhat longer than the legs at the left, so that the frame is inclined slightly.

Frame 12 includes a guide track 16 along which individual balls 18 are projected by a projection mechanism 20, more fully described hereinafter, through the guide track to an open well 22 formed at the right end of the frame. This well has a curved rear end wall 24 along which the projected balls 18 move. The well communicates with a series of pockets or elongated troughs 26, each of which is identified by suitable indicia printed or molded on the plastic frame 12, to represent an out, ball, strike or hit. The hit pocket 26*a*, is located in the center of the pocket array.

A play surface or turntable 28 is rotatably mounted on frame 12 and has a simulated baseball diamond printed or molded thereon. Play surface 28 is operatively connected to a drive mechanism (not seen in FIG. 1) which functions to rotate the play surface in a counterclockwise direction. A stop mechanism is also provided in the frame 12 and has a portion thereof operatively associated with hit pocket 26*a* so that when a ball enters the hit pocket the stop mechanism is released and surface 28 is allowed to rotate, under the influence of its drive, through a predetermined rotary movement, of one revolution or less, to simulate a home run, triple, double or single.

Toy figurines 30 are adapted to be removably positioned on the play surface, as described hereinafter, and an abutment 32 is provided at the left end of the frame to define a scoring station 34 (representing home plate). The abutment automatically removes a figurine from the play surface as a figurine at "third base" moves towards the scoring station during rotation of the play surface.

Figure 2:
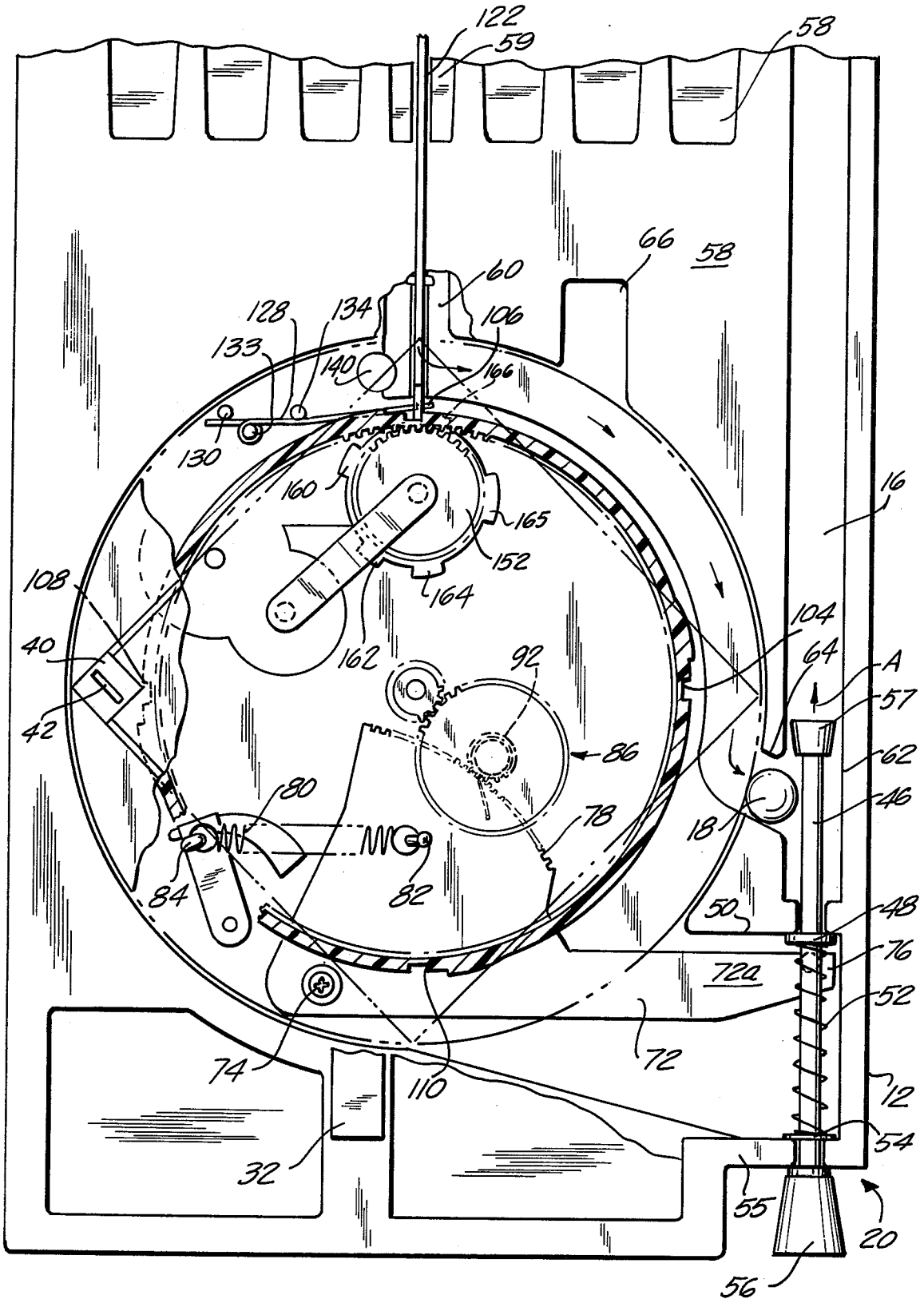
FIG. 2 is a plan view of the game illustrated in FIG. 1, with parts of the rotating disc and upper surface of the frame broken away to illustrate the operating mechanism of the game.
Figure 3:
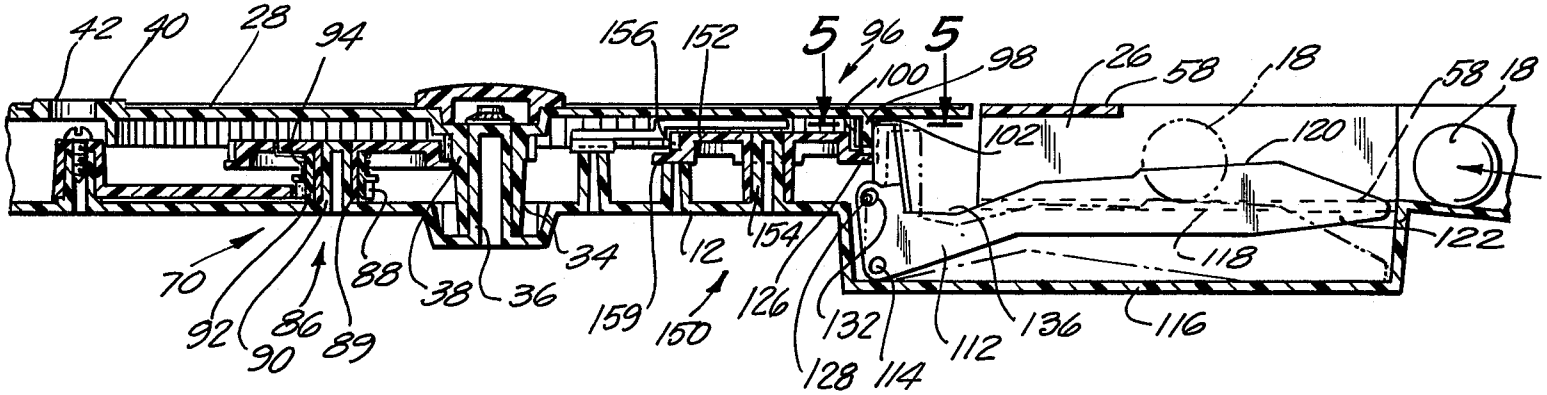
FIG. 3 is a longitudinal sectional view taken along line 3—3 of FIG. 1.

Referring more specifically to FIGS. 2 and 3, the play surface or turntable disc 28 includes a central hollow collar 34 which is rotatably received on a stud 36, formed in the bottom of frame 12, and has an integral annular gear 38 formed thereon. In addition, play surface 28 has square projections 40 formed on its upper surface to simulate the bases of a baseball diamond, and each of these projections has a through opening or slot 42 formed thereon. This slot is adapted to receive a flange element 44 formed at the base of each of the figurines 16.

Figurines 16 are provided in two sets, each being of a different color, for use by two players in playing the game. As each player has his turn at bat, he first places one of his figurines with its flange 44 in the slot 42 of the base at the scoring station (or home plate position) 34 to simulate the batter. The player then operates projection mechanism 20 to project a ball into the well 22 and thus into one of the pockets 26. If the ball enters the hit pocket the play surface 28 rotates in amounts sufficient to move the batter thereon to first, second, third or home plate depending upon the nature of the hit. When movement of play surface 28 stops, the player places another figurine in the base now at scoring station 34 to represent the next batter, and again projects ball 18 into the well 22. When a figurine makes a complete circuit from home plate and back again as a result of rotation of play surface 28 it is engaged by the abutment 32 as it moves from third base to home plate and knocked off surface 28 into a well 180 in frame 12. This provides an indication that a run is scored. At the end of an inning the batting team or player simply counts the number of figurines in well 180 to determine how many runs he scored in that inning.

Projection mechanism 20, seen most clearly in FIG. 2, consists of an elongated rod 46 slidably mounted for longitudinal movement in frame 12. Rod 46 includes an integral stop member 48 which limits forward movement of the rod in the direction of arrow A by engaging an abutment wall 50 formed in the frame. The rod is biased to this forwardmost position by a coil spring 52 which surrounds the rod and engages the shoulder 48. The opposite end of the spring engages a washer 54 slidably mounted on the rod and normally biased by spring 52 against the end wall 55 of the frame. In order to project a ball 18 into track 16, the plunger handle 56 is retracted to compress spring 52 and allow a ball 18 to enter track 16, from storage channel 60, described more fully hereinafter, into contact with the end face 57 of rod 46. The rod is then released and spring 52 returns the rod to its original position, shown in FIG. 2, thereby propelling ball 18 along track 16.

All of the pockets 26, except the hit pocket **26*a*, have closed bottom surfaces 58 so that a ball entering those pockets remains in the pockets and must be manually removed from the game after the end of each half inning. However the hit pocket has an open front wall so that a ball entering the hit pocket will continue through the pocket beneath the top surface 58 of frame 12, and move into a trough or channel 60 formed in the frame. This trough extends from the hit pocket, as illustrated in FIG. 2, in an arcuate path to a position adjacent the lower end 62 of track 16 to an opening 64 communicating with track 16 adjacent the end of face 57 of rod 46. In addition the top surface 58 of frame 12 includes an opening 66 formed therein through which balls 18 may be introduced into the channel 60** at the beginning of the game for storage to provide a continuous supply of balls to the batter during his half inning.

In order to prevent return of a projected ball from well 22, guide track 16 is provided with a pivoted gate 19 at its end adjacent well 22. When a ball is projected up the guide track 16, its momentum pivots the gate upwardly to permit the ball to enter the well. However the gate then returns to its vertical position and prevents the ball from returning down the guide track.

The drive mechanism 70 for rotating play surface 28 is located below the play surface on the base of frame 12. This drive mechanism includes a lever 72 pivotally mounted on a post 74 in base 12, in any convenient manner. The lever includes an arm **72*a* having a stud or abutment 76 formed thereon (illustrated in dotted lines in FIG. 2) located below and in proximity to shoulder 48 on rod 46. In addition the lever includes a segment gear 78 formed on one side thereof. The lever is normally biased into the position illustrated in FIG. 2 so that stud 76 is held against shoulder 48 by a spring 80 which is operatively connected at its ends to a stud 82 formed on the lever 72 and a stud 84 formed on a portion of the frame 12. By this arrangement, when rod 46 is retracted in order to project a ball 18, lever 72 is rotated in a clockwise direction and will return to its original position (except as noted hereinafter) under the influence of spring 80**.

Drive mechanism 70 also includes a one way spring clutch 86. This clutch includes a gear 88 (see FIG. 3) having a collar 89 rotatably mounted on a stud 90 formed in the base of frame 12. This crown gear is in meshing engagement with the gear 38 formed on collar 34 of play surface 28. The clutch also includes a second gear element 92 which is rotatably mounted on collar 89 of gear 88 in meshing engagement with segment gear 78 on lever 72. Gears 88, 92, are operatively connected by a coil spring 94 which surrounds a portion of gear 92, and respectively engages, in its opposite ends, the two gears 88, 92. The spring is arranged such that rotation of the gear 92, which in turn causes the spring to tighten and contract, if the gear 88 is held stationary. Since that gear is normally held stationary by the stop mechanism 96 (more fully described hereinafter) the spring 94 is energized and will thereafter rotate gear 88, when the stop mechanism is released.

Stop mechanism 96 includes an annular internal ring gear 98 formed integrally with play surface 28 on the lower side thereof. This ring gear has teeth 100 formed on its inner surface and an outer annular surface 102 in which four recesses 104, 106, 108 and 110 are formed. These recesses are respectively located below bases 40 on the play surface.

A generally L-shaped lever 112 is pivotally mounted at 114 in a well 116 formed below hit pocket 26. The long leg 118 of the lever has an upper surface 120 which extends through a slot 122 formed in base 58 of hit pocket **26*a*, while the short leg 124 of the lever has a front face 126 which normally is engaged with the annular outer surface 102 of ring gear 98. The lever is biased into the solid line position shown in FIG. 3 with the lever surface 126 held in engagement with surface 102 by a spring 128 mounted on a stud 130 in the base of frame 12 and having one end extending through an opening 132 in leg 124. The leg 133 of spring 128 is engaged against another stud 134 on frame 12, located between stud 130 and lever 112. The stud 134 is located to bend leg 133 slightly, as seen in FIG. 3, to cause the spring to normally bias leg 124 of lever 112 towards recesses 104–110 formed in surface 102, thereby to normally prevent movement of the play surface 28. Since the play surface is normally locked against movement in this manner, the transmission through the gears 98, 38 and 88 is locked against movement, so that when the rod 46 is retracted to rotate lever 72, only gear 92 will be rotated, in order to tighten and energize spring 94. In addition, once spring 94 has been energized, and as long as lever 112 keeps play surface 28 in a locked position, the spring cannot release to rotate either gears 88 or 92, and thus lever 72 will be held against movement, against the bias of its biasing spring 80**.

When a ball 18 enters hit pocket **26*a* it rides onto the tapered surface 120 of long leg 118 of lever 112 and its weight causes the lever to move to the dotted line position illustrated in FIG. 3, against the bias of spring 128, thereby disengaging leg 124 from the recesses in wall 102 with which it had previously been engaged. Releasing the play surface in this manner permits the play surface to rotate under the influence and drive of a spring 94. The ball continues its rolling movement down surface 120 of the lever into an enlarged recess 130 formed in the lever which communicates with channel 60. A bumper 140 mounted adjacent the channel urges the ball off of the lever and into channel 60 so that it moves back towards opening 64 adjacent guide track 16** for reuse.

When the ball 18 falls off of lever 112 into channel 60 the lever is free to return to its solid line position under the influence of spring 128 so that its front face 126 engages the surface 102 of the ring gear 98. Thus it will be in position to enter the next recess along the surface 102 which passes in juxtaposition to the end of the lever or detent, in order to stop further movement of the disc under the influence of the spring 94. However, with just this arrangement the play disc would only rotate one quarter of a revolution each time a ball entered the hit pocket **26*a***.

In order to provide a greater variety of permissible disc movements, and to simulate the actions of a baseball game with apparently random hits, a program mechanism 150 is provided which includes a crown gear 152 rotatably mounted on a stud 154 in frame 12, adjacent the forward end 126 of the lever 112. The gear 152 is located such that its gear teeth 156 mesh with the internal gear teeth 100 of ring gear 98 so that during rotation of the play surface 28 gear 152 is also rotated. In addition, this crown gear includes a laterally extending peripheral flange 158, having five cam lobes 160, 162, 164, 165 and 166 formed thereon.

Figure 6:
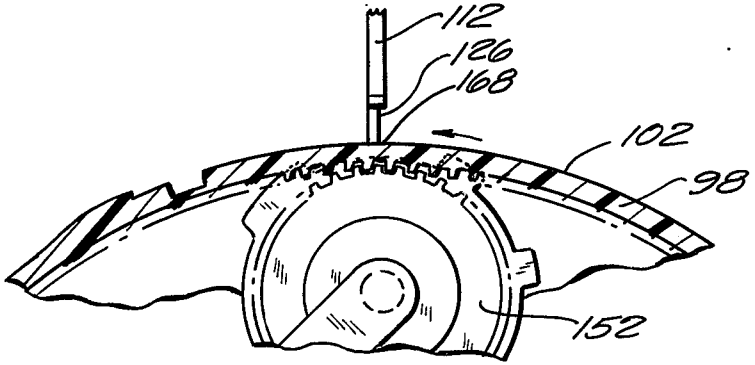
FIG. 6 is a plan view similar to FIG. 5 showing another configuration of the stop mechanism during movement of the play surface.
Figure 5:
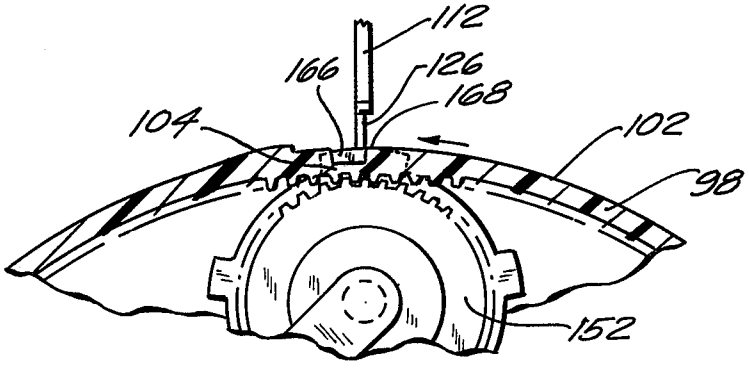
FIG. 5 is a plan view taken along line 5—5 of FIG. 3 showing one configuration of the stop mechanism for the play surface, during rotation thereof with a lobe of the random cam blocking a stop notch in the field disc.

The cam lobes are located (as seen in FIGS. 5 and 6) such that their peripheries 168 align, in plan, with the peripheral surface 102 of ring gear 98. In this manner, the cam lobes are sequentially brought into juxtaposition with the end 126 of the lever 112. Accordingly the cam serves to block recesses 104—110 in surface 102 during various portions of the rotation of gear 152.

The provision of the cam elements or lobes 160—166 controls the amount of rotation permitted in dics 28 and provides a programmed sequence of permissible movements in the disc ranging from one quarter of a revolution to a half, three quarters and one full revolution to represent a single, double, triple and home run. The sequence arrived at by the programmed cam of the invention is adjusted to approximately represent the occurrence of these various types of hits during the course of a normal baseball game. The sequence is quite long, and thus a player is not able to predict what the next hit will be.

Figure 7:
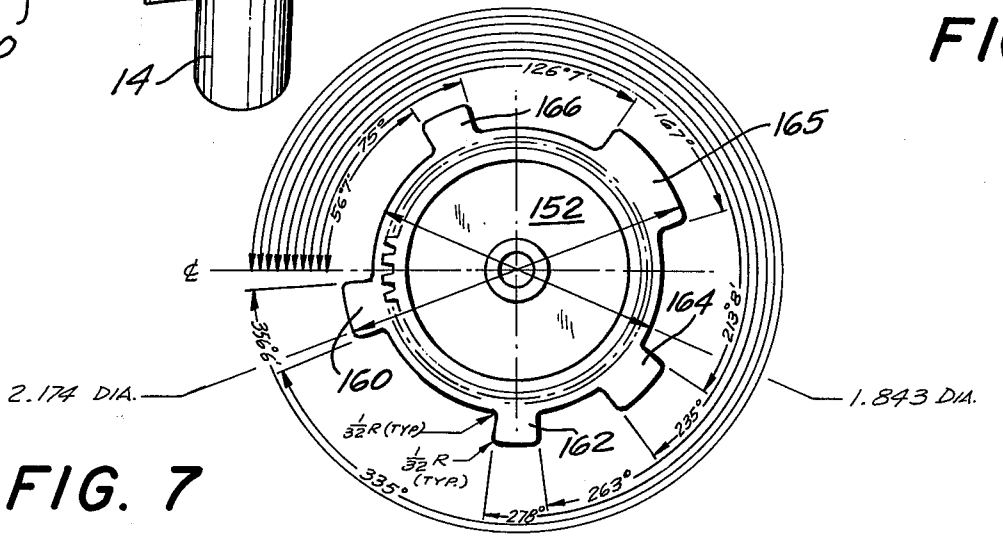
FIG. 7 is a plan view of the cam used to produce the apparent random sequence of movements of the playing field.

In accordance with a presently preferred embodiment of the invention gear teeth 98 has 228 teeth, with approximately 57 teeth being located between each of the recesses 102; while the gear 152 has 55 teeth formed thereon. Accordingly, it takes approximately 55 revolutions of the play surface 28 in order to complete an entire sequence of hits by the arrangement of the present invention. In this connection it has been found that while the circumferential length of the lobes or protuberances of the cams can be formed within wide limits, it is preferred that these cams be positioned and arrayed with respect to each other according to the angular relationship shown in FIG. 7.

Accordingly, during the play of the game when a ball 18 enters hit pocket **26*a*, it moves onto the surface 120 of lever 112, to release the engagement of the surface 126 of the lever with a juxtaposed recess in the annular surface 102 of the play surface or disc 28. This releases the play surface for drive by spring 94, which had previously been energized by retraction of the projection mechanism rod 46, so as to drive the disc in rotation. As the disc commences rotating, its rotation causes gear 152 to simultaneously rotate. After the play surface has rotated through one quarter of a revolution, to represent a one base hit, if the recess then juxtaposed with lever surface 126 is not blocked by one of the cam elements of gear 152, the end 124 of lever 112 enters the recess and blocks further movement of the play surface. The play surface will be held in that fixed position until another ball enters the hit pocket. However if, as illustrated in FIG. 5, after one quarter of a turn of disc 28, one of the cam elements is in juxtaposition with the end 124 of lever 112, below one of the recesses in surface 102, movement of the lever into the recess is blocked and the play surface will continue to rotate, to signify a hit of more than one base. The disc 28 thus will continue to rotate until a recess is presented in juxtaposition to the end 124 of the lever without a cam of gear 158 being therebelow so that the end of the lever can enter the recess and stop rotation of the play surface. As mentioned, the cam lobes 160—166 and the number of teeth on the gears 152 and 98** are arranged such that at most one full revolution of the play surface will be permitted.

The game of the invention is played according to the normal rules of baseball, with each of the players having his turn at bat. As mentioned, when a player commences his turn at bat there are no players on the play surface 28 and he places one of his figurines on the base 40 adjacent the batting or scoring station 34. The player then commences to project balls 18 into well 22. If a ball enters any of the out pockets, it is counted as an out and when the player has three outs it becomes the next player's turn at bat. If the balls enter the ball or strike pockets the balls and strikes are recorded in the same manner as a baseball game. If a player gets four balls in the ball pockets before striking out or otherwise making an out, or getting a hit, he moves the figurine to the base representing first base, to indicate a walk, and a new figurine is placed at the station 34.

If one of the projected balls enters the hit pocket **26*a*, the lever 112 is actuated to release the stop mechanism and permit the disc 28 to rotate, as described above. The disc will rotate to an amount determined by the programmed cam to move the figurine at the batting station with the disc to represent a single, double, triple or home run. When a figurine on the play surface completes one full revolution with the play surface from its starting point at batting station 34, it is engaged by the abutment 32, which simply resists further movement of the figurine with the play surface, and causes the figurine to disengage from slot 42 on the play surface. The figurine then falls into the well 180** to signify that a run has been scored. The players continue playing in this manner until one player's side is out and the next player then has his turn at bat.

Accordingly it is seen that a relatively simply constructed pinball type baseball game is provided which is suitable for use by children in the home. The mechanism by which the movement of the play surface is controlled provides an apparently random movement of the play surface to give an apparently random occurrence of different types of base hits.

Although an illustrative embodiment of the present invention has been described herein with reference to the accompanying drawings, it is to be understood that the invention is not limited to that precise embodiment thereof, but that various changes and modifications may be effected therein by one skilled in the art without departing from the scope or spirit of this invention.

What is claimed is:

1. A baseball comprising a frame, a play surface rotatably mounted on the frame and simulating a baseball diamond; a plurality of figurines adapted to be selectively and removably mounted on said play surface at predetermined locations representing the bases of said baseball diamond; selectively operable means in said frame for rotating said play surface on the frame in an apparently random sequence of different angular movements of one revolution and less including selectively operable drive means for rotating said play surface and selectively releasable stop means for selectively preventing rotation of said play surface under the influence of said drive means after an angular movement of the play surface equal to one revolution or less in an apparently random sequence; said selectively releasable stop means including an annular wall formed on said play surface and rotating therewith, said wall having a plurality of recesses formed therein, a detent movably mounted in said frame, and means for normally biasing said detent against said wall for movement into a recess when the recess and detent are in juxtaposition to prevent rotation of the play surface; and means for randomly releasing said detent from engagement in the recess of said annular wall to permit rotation of the play surface; said stop means including a cam rotatably mounted in the frame for rotation with the play surface and having cam projections on its periphery located adjacent the periphery of the annular wall and the detent to selectively block recesses of the annular wall according to a predetermined pattern during sequential rotations of the play surface thereby preventing, according to a predetermined pattern, return of the detent into a recess of the annular wall when the recess and the detent are in juxtaposition, whereby rotation of the play surface is stopped according to an apparently random pattern after a rotation of one revolution or less.

2. A game as defined in claim 1 wherein said frame includes means located at a predetermined position thereon for removing said figurines from the play surface when the figurine has rotated with the play surface through one full revolution of the play surface.

3. The game as defined in claim 1 wherein said detent is a lever pivotally mounted in the frame and said random releasing means comprising a plurality of balls and means for projecting the balls along the frame at the lever to a position whereby the balls can randomly engage the lever to pivot it against said biasing means, thereby to release said play surface for rotation.

4. A pinball type baseball game comprising, a frame having a ball guide track formed therein and a plurality of ball receiving pockets communicating with said track; a plurality of balls, and selectively operable means for projecting individual balls along the track towards said pockets for random entrance therein; a play surface rotatably mounted on said frame and simulating a baseball diamond; a plurality of figurines adapted to be selectively and removably mounted on said play surface at predetermined locations thereon representing the bases of said diamond, drive means in said frame for rotating said play surface, and releasable stop means operatively associated with one of said pockets for normally holding said playing surface against rotation by said drive means and for releasing said play surface for limited rotation by said drive means through an arc of varying lengths and of one revolution or less according to a predetermined and apparently random pattern in response to entrance of a ball into said one pocket; said releasable stop means including an annular surface on said play surface having a plurality of recesses formed therein spaced arcuately from one another by 90°, a spring lever pivotally mounted in said frame having one end engaged with said annular surface and one end located in said one pocket in position to be engaged by a ball rolling into the pocket and pivoted in response to engagement by the ball to move said one end thereof away from said annular surface, and means for normally biasing said one end of the lever against said surface for movement into a recess therein when a recess is moved into juxtaposition with the lever during rotation of the play surface, whereby engagement of the lever in said one pocket by a ball will release the engagement of the lever and recess in said annular surface to allow the play surface to be driven; and a program cam rotatably mounted in said frame and drivingly engaged with said play surface to be rotated by the play surface when the play surface is rotated; said cam having a plurality of cam protuberances thereon and being located in the frame in a position adjacent said lever and wherein the protuberances align, in plan, with the periphery of said annular surface thereby to block the recesses which move into juxtaposition with the lever according to a predetermined pattern which produces an apparently random sequence of angular movements of the play surface of one revolution or less each time a ball enters said one pocket.

5. A pinball type baseball game as defined in claim 4 wherein said drive means includes a one-way spring clutch rotatably mounted in the frame and having an output member drivingly engaged with the play surface, and means for energizing the spring of the clutch while the play surface is held against rotation by said stop means.

6. A pinball type baseball machine as defined in claim 5 wherein said energizing means includes a gear means operatively connected to the spring of the spring clutch and means responsive to actuation of said projection means to turn said gear and tighten the spring of the clutch.

7. A pinball type baseball game comprising, a frame having a ball guide track formed therein and a plurality of ball receiving pockets communicating with said track; a plurality of balls, and selectively operable means for projecting individual balls along the track towards said pockets for random entrance therein; a play surface rotatably mounted on said frame and simulating a baseball diamond; a plurality of figurines adapted to be selectively and removably mounted on said play surface at predetermined locations thereon representing the bases of said diamond; drive means in said frame for rotating said play surface, and releasable stop means operatively associated with one of said pockets for normally holding said playing surface against rotation by said drive means and for releasing said play surface for limited rotation by said drive means through an arc of varying lengths and of one revolution or less according to a predetermined and apparently random pattern in response to entrance of a ball into said one pocket; said drive means including a one way spring clutch rotatably mounted in the frame and having an output member drivingly engaged with the play surface, and means for energizing the spring of the clutch while the play surface is held against rotation by said stop means; said releasable stop means including an annular surface on said play surface having a plurality of recesses formed therein arcuately spaced from one another by 90°, a spring lever pivotally mounted in said plane having one end engaged with said annular surface and one end located in said one pocket in position to be engaged by a ball falling into the pocket and pivoted in response to engagement by the ball to move said one end thereof away from said annular surface, and means for normally biasing said one end of the lever against said surface for movement into a recess therein when a recess is moved in juxtaposition with the lever during rotation of the play surface, whereby engagement of the lever in said one pocket by a ball will release the engagement of the lever and recess in said annular surface to allow the play surface to be driven by the spring clutch; said stop means including a program cam rotatably mounted in said frame and drivingly engaged with said play surface to be rotated by the play surface when the play surface is rotated by the spring clutch; said cam having a plurality of cam protuberances and being located in the frame in a position adjacent said lever and wherein the protuberances align, in plan, with the periphery of said annular surface thereby to block the recesses which move into juxtaposition with the lever according to a predetermined pattern which produces an apparently random sequence of angular movements of the play surface of one revolution or less each time a ball enters said one pocket.

8. A pinball type baseball game as defined in claim 7 including means on said frame for removing figurines from the play surface; said removing means being located at a predetermined position on the frame defining "home plate".

9. A device comprising a frame, a disc rotatably mounted on said frame, drive means for rotating said disc, releasable stop means for normally holding said disc against rotation by said drive means and for releasing said disc for limited rotation by said drive means through rotary movement of different arc lengths of a predetermined number of revolutions or less according to a predetermined and apparently random pattern; and means for releasing said stop means; said releasable stop means including an annular surface on said disc having a plurality of arcuately spaced recesses formed therein, a detent movably mounted in said frame and means for normally biasing said detent against said surface for movement into a recess in said annular surface when a recess and said detent are in juxtaposition to prevent rotation of the disc; said release means being selectively actuable to move the detent away from said surface and out of engaged recess to permit rotation of the disc at least until the next recess as the surface moves into juxtaposition with the detent; and program means mounted in said frame for blocking the recesses which move into juxtaposition with said lever according to a predetermined pattern which produces an apparently random sequence of movement of the play surface each time the detent is released from a recess by said release means.

10. A device comprising a frame, a disc rotatably mounted on said frame drive means for rotating said disc, releasable stop means for normally holding said disc against rotation by said drive means and for releasing said disc for limited rotation by said drive means through rotary movement of different arc lengths of a predetermined number of revolutions or less according to a predetermined and apparently random pattern; and means for releasing said stop means; said releasable stop means including an annular surface on said disc having a plurality of arcuately spaced recesses formed therein, a detent movably mounted in said frame and means for normally biasing said detent against said surface for movement into a recess in said annular surface when a recess and said detent are in juxtaposition to prevent rotation of the disc; said release means being selectively actuable to move the detent away from said surface and out of engaged recess to permit rotation of the disc at least until the next recess as the surface moves into juxtaposition with the detent; said stop means including a program cam rotatably mounted in said frame and drivingly engaged with said disc to be rotated by the disc when the disc is rotated; said cam having a plurality of cam protuberances and being located in the frame in a position adjacent the detent wherein the protuberances align, in plan, with the periphery of said annular surface thereby to block the recesses which move into juxtaposition with the lever according to a predetermined pattern which produces an apparently random sequence of annular movements of the play surface each time said detent is released from a recess by said release means.

11. A device as defined in claim 10 wherein said predetermined number of revolutions is one revolution of the disc.

12. A device as defined in claim 10 wherein said drive means includes a one-way spring clutch rotatably mounted in the frame and having an output member drivingly engaged with said disc, and means for engaging the spring of the clutch while the play surface is held against rotation by said stop means.

13. A baseball game comprising a frame, a play surface rotatably mounted on said frame and simulating a baseball diamond; a plurality of figurines adapted to be selectively and removably mounted on said play surface at predetermined locations representing the bases of said baseball diamond; and selectively operable means in said frame for rotating said play surface on the frame in an apparently random sequence of different angular movements of one revolution and less; said selectively operable means including an annular wall on said play surface having a plurality of recesses formed therein, a detent movably mounted on said frame and normally biased against said wall for movement into said recesses; means for randomly releasing said detent and means for selectively blocking said recesses of said wall according to a predetermined pattern during sequential rotations of the play surface to prevent entrance of the detent into a recess and thereby control the amount of angular rotation of the play surface permitted upon release of the detent.

14. A baseball game as defined in claim 13 wherein said blocking means comprises a cam rotatably mounted in the frame for rotation with the play surface and having cam projections on its periphery located adjacent the periphery of the annular wall and the detent to selectively block recesses of the annular wall according to a predetermined pattern during sequential rotations of the play surface.

* * * * *